US011587714B2

(12) United States Patent
Moreno et al.

(10) Patent No.: US 11,587,714 B2
(45) Date of Patent: Feb. 21, 2023

(54) TRANSFORMER FOR FASTENING TO A MAST OF AN ENERGY DISTRIBUTION NETWORK

(71) Applicant: Siemens Energy Global GmbH & Co. KG, Munich (DE)

(72) Inventors: Andre Luiz Moreno, Varzea Paulista (BR); Martin Alsina Navarro, Jundiai (BR); Richard Sille, Kirchheim (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 291 days.

(21) Appl. No.: 16/765,944

(22) PCT Filed: Oct. 24, 2018

(86) PCT No.: PCT/EP2018/079121
§ 371 (c)(1),
(2) Date: May 21, 2020

(87) PCT Pub. No.: WO2019/101458
PCT Pub. Date: May 31, 2019

(65) Prior Publication Data

US 2020/0357559 A1 Nov. 12, 2020

(30) Foreign Application Priority Data

Nov. 21, 2017 (DE) ..... 102017220782

(51) Int. Cl.
*H01F 27/06* (2006.01)
*H01F 27/28* (2006.01)
(Continued)

(52) U.S. Cl.
CPC ..... *H01F 27/06* (2013.01); *H01F 27/08* (2013.01); *H01F 27/24* (2013.01); *H01F 27/28* (2013.01)

(58) Field of Classification Search
CPC ..... H01F 27/06; H01F 27/08; H01F 27/24; H01F 27/28; H01F 27/266; H01F 27/327; H01F 27/022; H01F 27/23
See application file for complete search history.

(56) References Cited

U.S. PATENT DOCUMENTS 2,975,385 A 3/1961 Novak
3,213,397 A 10/1965 Broverman
(Continued)

FOREIGN PATENT DOCUMENTS

CN 101809686 A 8/2010
CN 202134359 U 2/2012
(Continued)

OTHER PUBLICATIONS

Hörmann W. et al: "Neue Norm zum Schutz gegen elektrischen Schlag", Elektropraktiker, 2007, No. 9, pp. 780-790 [downloaded Oct. 30, 2018]—Statement of Relevance.
(Continued)

*Primary Examiner* — Bernard Rojas
(74) *Attorney, Agent, or Firm* — Laurence A. Greenberg; Werner H. Stemer; Ralph E. Locher

(57) ABSTRACT

A transformer for mounting on a mast of an air-insulated energy distribution network has a core which is protected against corrosion and environmental influences, while at the same time stable retention is provided. The transformer contains a winding block having a solid insulating body, in which at least one upper voltage winding and at least one lower voltage winding are arranged. The winding block delimits a completely peripherally closed central retention opening. Furthermore, a core unit is provided which has at least one magnetizable core and is inductively coupled to each lower voltage winding by each upper voltage winding. The core unit extends through the retention opening via at least one core leg and annularly extends around the winding
(Continued)

block on the outside by a ring portion. Retention devices are provided for fastening the ring portion to the mast.

9 Claims, 3 Drawing Sheets

(51) Int. Cl.
*H01F 27/24* (2006.01)
*H01F 27/08* (2006.01)

(56) References Cited

U.S. PATENT DOCUMENTS

| | | | | |
|---|---|---|---|---|
| 3,263,196 | A | 7/1966 | Reber | |
| 3,371,299 | A * | 2/1968 | Radkowski | H01F 27/12 336/60 |
| 5,275,368 | A | 1/1994 | Hall et al. | |
| 6,411,188 | B1 | 6/2002 | Pruess et al. | |
| 11,250,990 | B2 * | 2/2022 | Zhang | H01F 27/04 |
| 2004/0217836 | A1 * | 11/2004 | Archambault | H01F 27/06 336/182 |
| 2011/0175696 | A1 | 7/2011 | Hanov et al. | |
| 2015/0263636 | A1 | 9/2015 | Bala | |

FOREIGN PATENT DOCUMENTS

| | | | |
|---|---|---|---|
| CN | 104937514 | A | 9/2015 |
| CN | 105261468 | A | 1/2016 |
| DE | 69909604 | T2 | 6/2004 |
| DE | 202013004440 | U1 | 5/2014 |
| EP | 3089179 | A1 | 11/2016 |
| GB | 1182871 | A | 3/1970 |
| WO | WO 0108175 | A1 | 2/2001 |
| WO | WO 2011126991 | A1 | 10/2011 |

OTHER PUBLICATIONS

Hörmann W. et al: "Neue Norm zum Schutz gegen elektrischen Schlag"; In: Elektropraktiker;2007; Nr. 9; pp. 780 bis 790; nicht identifizierbar [abgerufen am Oct. 30, 2018].

* cited by examiner

TRANSFORMER FOR FASTENING TO A MAST OF AN ENERGY DISTRIBUTION NETWORK

BACKGROUND OF THE INVENTION

Field of the Invention

The invention relates to a transformer for mounting on a mast of an energy distribution network.

A transformer of this type is known, for example, from WO2001/08175 A1. The transformer disclosed therein is provided for mounting on a mast of an air-insulated energy distribution network and, in consequence, can also be described as a mast transformer. The mast transformer disclosed herein comprises a higher-voltage winding and lower-voltage windings, which are arranged in an electrically insulating resin block in the form of an insulating body. A bushing is formed on the solid resin block which, at the end thereof which is averted from the resin block, incorporates an overhead line terminal, the function of which is to connect to an air-insulated phase conductor of the energy distribution network. The higher- and lower-voltage windings are inductively coupled to one another by means of an iron core which is arranged externally to the resin block, such that the desired voltage transformation is permitted. In order to prevent voltage spikes in the resin block, insofar as possible, a grounded shielding is provided in the form of a metal cage, which entirely encloses the higher-voltage winding.

The known mast transformer is handicapped by a disadvantage, in that the resin block and the core do not constitute a stable and secure unit.

SUMMARY OF THE INVENTION

The object of the invention is therefore the provision of a transformer of the abovementioned type, the core of which is protected against environmental influences and corrosion and wherein, simultaneously, a secure retention of the core and the resin block is provided.

The invention fulfills this object by means of a transformer having a winding block which comprises a solid insulating body, in which at least one higher-voltage winding and at least one lower-voltage winding are arranged, wherein the winding block delimits an entirely peripherally closed central retention opening, a core unit which comprises at least one magnetizable core and is inductively coupled to each lower-voltage winding by means of each higher-voltage winding, wherein the core unit extends through the retention opening by means of at least one core limb and annularly encloses the winding block on the exterior by means of a ring portion, and having retaining means for fastening the ring portion to the mast.

According to the invention, a winding block having a solid insulating body is provided, in which the higher- and lower-voltage windings are arranged. This winding block constitutes a retention opening. The core unit is arranged externally to the insulating body and thus, according to the invention, extends through said retention opening.

The arrangement of the core unit externally to the insulating body is advantageous in that, during the operation of the transformer, magnetic fields are preferably directed within the interior of the core unit. Although the core unit is preferably comprised of mutually adjoining magnetizable electrical steel sheets or strips, eddy currents occur during operation which are responsible for the heat-up of the core unit. The associated geometrical expansion of the core unit is dependent upon the magnitude of the magnetic field and the coefficients of thermal expansion of the core material employed. As the core unit is arranged externally to the insulating body, any cracks in the insulating body associated with a differential thermal expansion of the core and the insulating body are prevented.

As the core unit extends through the retention opening, it is sufficient, according to the invention, that the retaining means are employed solely for the fastening of the annular ring portion of the core unit. The winding block is supported in this case by the core limb which extends through the retention opening. The retention system according to the invention is consequently simple, and thus cost-effective. Moreover, a rapid fitting of the transformer to the mast is made possible, wherein the fastening means moreover provide protection for the core unit, which is sensitive to environmental influences.

Appropriately, the section of the core unit which projects through the retention opening, with respect to its outer contour, is adapted to the inner contour of the retention opening. In other words, the external diameter of said core unit section is somewhat smaller than the internal diameter of the retention opening, such that a mechanically stable unit is provided.

Naturally, in the context of the invention, it is possible that, between the core unit section which extends through the retention opening and the insulating body in this region, holding or insulating materials are arranged for the improvement of mechanical retention and the prevention of vibrations.

The core unit comprises at least one core which is configured, for example, in the form of a "wound core". Thus, for example, each core comprises "core winding layers", which are led through the retention opening. However, wound cores and materials of this type are already highly familiar to a person skilled in the art, such that any further description thereof can be omitted at this point.

The core unit can comprise only one core having a central core limb, which extends through the retention opening, and two return limbs which, in combination with the yoke, constitute the ring portion. By way of deviation, a plurality of cores can be provided, each of which constitutes a closed iron core circuit or magnetic circuit per se.

Advantageously, the core unit is impregnated with a curable polymer. As described above, the core is exposed to environmental influences, and is preferably comprised of a ferromagnetic material, in particular an electrical steel sheet or strip which is configured, for example, as a grain-oriented electrical sheet steel. The overall thickness of the material which is wound to constitute a loop of the coil lies, for example, between 0.1 mm and 0.5 mm. Soft magnetic materials must be protected against corrosion, such that the magnetic induction effect of the core is not compromised. For this reason, a polymer is provided, which is introduced into the core unit in a liquid state. The core unit is impregnated with the liquid. Thereafter, the polymer is cured by the action of heat, for example in a kiln, and preferably in a vacuum kiln. The vacuum thus draws the still liquid polymer into all the interspaces which would otherwise be exposed to environmental influences such that, further to the complete polymerization of the polymer, effective protection for the core unit is provided. The polymer is, for example, a standard proprietary resin, or a polymer which is otherwise employed in the field of transformer construction. The polymer can incorporate customary admixtures.

According to a further configuration of the invention, the retaining means incorporate a supporting frame which is configured such that it entirely encloses the external ring portion of the transformer. In other words, the supporting frame provides secure protection against moisture and harmful environmental influences, such that the action of the impregnation which is optionally provided is reinforced by the supporting frame. In principle, the supporting frame can be configured in an arbitrary manner, provided that it ensures the complete encapsulation of the ring portion.

According to a preferred variant of the invention, however, the supporting frame comprises a closed peripheral sidewall with a C-shaped cross-section, which entirely encloses the ring portion. The ring portion runs around the exterior of the winding block in an annular manner or, in other words, in a ring shape, such that the latter can be arranged within the C-shaped supporting frame. Naturally, with respect to its dimensioning, the supporting frame is adapted to the ring portion, such that the complete enclosure of said ring portion is possible.

According to an appropriate further development with respect hereto, an insulating material is arranged between the supporting frame and the ring portion. The insulating material is responsible, for example, for noise reduction, and for the additional protection of the ring portion. An appropriate insulating material is, for example, an appropriate glass-fiber fabric which, in addition to its protective and noise reduction action, also permits sufficient cooling of the ring portion, which undergoes heat-up in service.

Advantageously, the core unit comprises two cores, each of which extends with one core limb through the retention opening, and each of which encloses one limb of the winding body over its full periphery. The cores are advantageously wound from an electrical steel strip, as described above.

Appropriately, between the core limbs of the cores which extend through the retention opening, at least one intermediate layer is arranged, which delimits cooling ducts. In this manner, adequate cooling of the cores is ensured, given that said cores undergo heat-up during operation and it is necessary for the heat thus generated to be evacuated.

Advantageously, intermediate layers are arranged between the winding block and the core unit, which delimit cooling ducts. According to this advantageous further development, intermediate layers are also arranged between the solid retention block and the core unit. Intermediate layers of a flexible material are conceivable, which form recesses by means of which the cooling ducts are constituted.

Advantageously, the retaining means incorporate a fastening rail for fitting to the mast, which is detachably connectable to the supporting frame by means of a form-fitted connection. A form-fitted connection of this type is, for example, a simple hook connection, which appropriately incorporates a retaining plate, in which a hook which is configured on the supporting frame can be suspended. However, the hook can also be configured on the fastening rail, wherein the hook comprises an upwardly extending free end, over which a retaining bracket of the supporting frame can be fitted.

Further advantages are conferred if a base structure for the retention of the winding block is provided, which is fastened to the supporting frame. The base structure is, for example, configured in the form of two retaining brackets, each of which is fitted on one side of the supporting frame and delimits a basket-shaped inner contour, which is configured with a matching shape to the outer contour of the winding block. In other words, the retaining brackets are configured such that the winding block can be supported on the latter.

However, the base structure can also be configured in any other manner and can also be configured with additional insulating material.

It is further appropriate that the supporting frame and/or the base structure is/are equipped with a grounding nut. The grounding nut permits, in a simple manner, the grounding of the shielding of the higher-voltage winding which is arranged in the retention block. Moreover, it is also possible for the transformer according to the invention to be connected in parallel with a "surge arrester". The surge arrester is connected by means of the retaining nut.

Further appropriate configurations and advantages of the invention are the subject matter of the following description of exemplary embodiments of the invention, with reference to the figures in the drawing, wherein identically functioning components are identified by the same reference numbers.

DETAILED DESCRIPTION OF THE INVENTION

Figure 1:
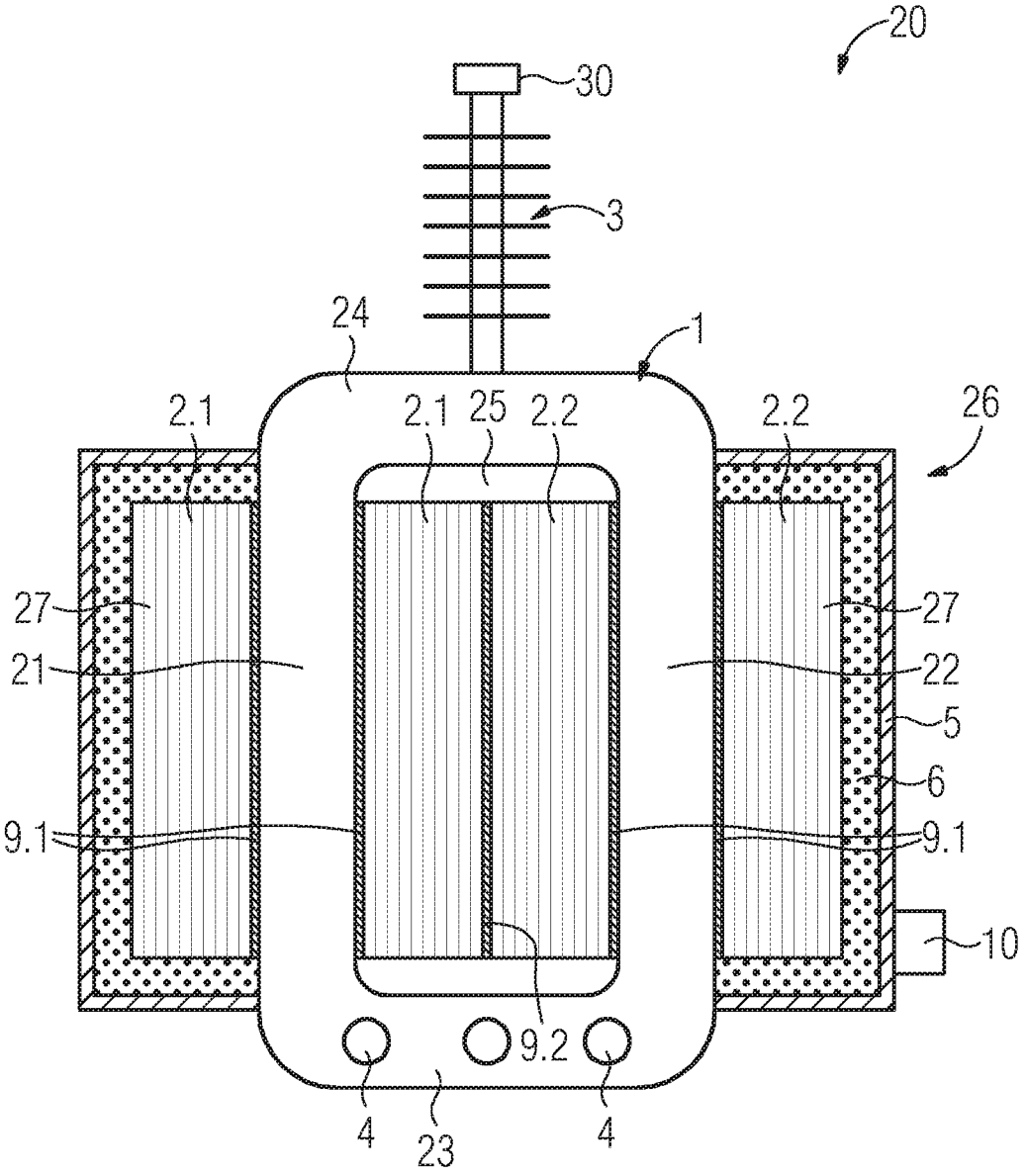
FIG. 1 illustrates a first exemplary embodiment of the transformer according to the invention, in a schematic sectional side view.

FIG. 1 shows an exemplary embodiment of the transformer 20 according to the invention in a schematic sectional side view. The transformer 20 incorporates a winding body 1, which comprises one or two solid and dry insulating bodies of cast resin, together with two lower-voltage windings and a higher-voltage winding. Said windings are not diagrammatically represented. The higher-voltage winding is arranged between the lower-voltage windings. The higher-voltage winding is further enclosed by a shielding which, likewise, is not diagrammatically represented.

A bushing 3 is formed on the winding body 1, which extends from the winding body 1 to a free end, at which an overhead line terminal 30 is constituted. A further correspondingly configured bushing is arranged directly behind the bushing 3, in the viewing direction, and is thus not visible in FIG. 1. Moreover, the insulating ribs of the bushing 3 are schematically represented. An inner conductor, which is not diagrammatically represented, extends through the bushing 3, and connects the overhead line terminal 30 to the higher-voltage winding of the winding body 1. In the lower winding body section 23, low-voltage terminals 4 are configured, which are respectively connected to the two lower-voltage windings.

The winding body 1 constitutes two winding body limbs 21 and 22, which are interconnected by means of a lower 23 and an upper 24 winding body section. The winding body limbs 21, 22 and the upper and lower winding body sections 23, 24 thus delimit a retention opening 25, through which a core unit 26 projects. The core unit 26 comprises a first core 2.1 and a second core 2.2, each of which encloses a winding body limb 21 or 22 over the full periphery thereof. Each core 2.1, 2.2 is a "wound core", wherein each core is comprised of a plurality of winding strips or electrical steel strips, which are arranged adjacently to one another. The electrical steel strips or electrical steel sheets are comprised of grain-oriented electrical sheet steel, or of an amorphous material. However, wound cores of this type will be familiar to a person skilled in the art, such that it is not necessary to address the latter in any greater detail at this point.

Each of the two cores 2.1 and 2.2 respectively comprises a limb, by means of which the respective core 2.1 or 2.2 extends through the retention opening 25. Externally to the retention opening 25, the core unit 26 extends around the winding body 1 in an annular manner at a ring portion 27.

For corrosion protection, the cores 2.1, 2.2, and specifically both the ring portion 27 and the limb which extends through the retention opening 25 have been impregnated with a polymer, in this case a resin. The resin has been applied to the core in a liquid state in a vacuum kiln such that, on the grounds of the vacuum, the liquid resin penetrates all the interspaces of the respective core 2.1, 2.2. Thereafter, the resin is cured by the heat of the kiln, such that the electrical steel strips or the electrical steel sheets of the cores 2.1 and 2.2 are impregnated with resin. In this manner, effective corrosion protection is provided.

For the enhancement of corrosion protection, but also for the fastening of the transformer 20, a supporting frame 5 is provided, which comprises C-shaped sidewalls which enclose the ring portion 27 of the core unit 26 over the full periphery thereof. In other words, the ring portion 27 is entirely arranged within the supporting frame 5. Between the supporting frame 5 and the ring portion 27, a corrosion-protection and an insulating material 6 is inserted, the function of which, firstly, is the provision of the requisite corrosion protection, and secondly the damping of noise associated with the operation of the transformer. As a corrosion-protection and insulating material 6, for example, an appropriate glass-fiber material is conceivable.

On the supporting frame 5, a grounding nut 10, which is screwed onto a stud of the supporting frame 5 which is provided with an external thread, is discernible, wherein said stud is connected to the abovementioned shielding. The grounding nut 10 permits a simple grounding of the shielding, but also the connection of the transformer to a surge arrester, such that the desired overvoltage protection of the transformer is provided.

Between the winding body limbs 21 and the respective section of the core 2.1 or 2.2, intermediate layers 9.1 are arranged, which are comprised of an elastomer and which constitute cooling ducts, which are delimited from the intermediate layer 9.1 to the respective limb 21 or 22, and to the respective core section. An intermediate layer 9.2 between the cores 2.1 and 2.2 also executes a delimiting function for the cooling ducts, wherein the intermediate layers are elastically configured and also assume a noise-reducing function.

Figure 2:
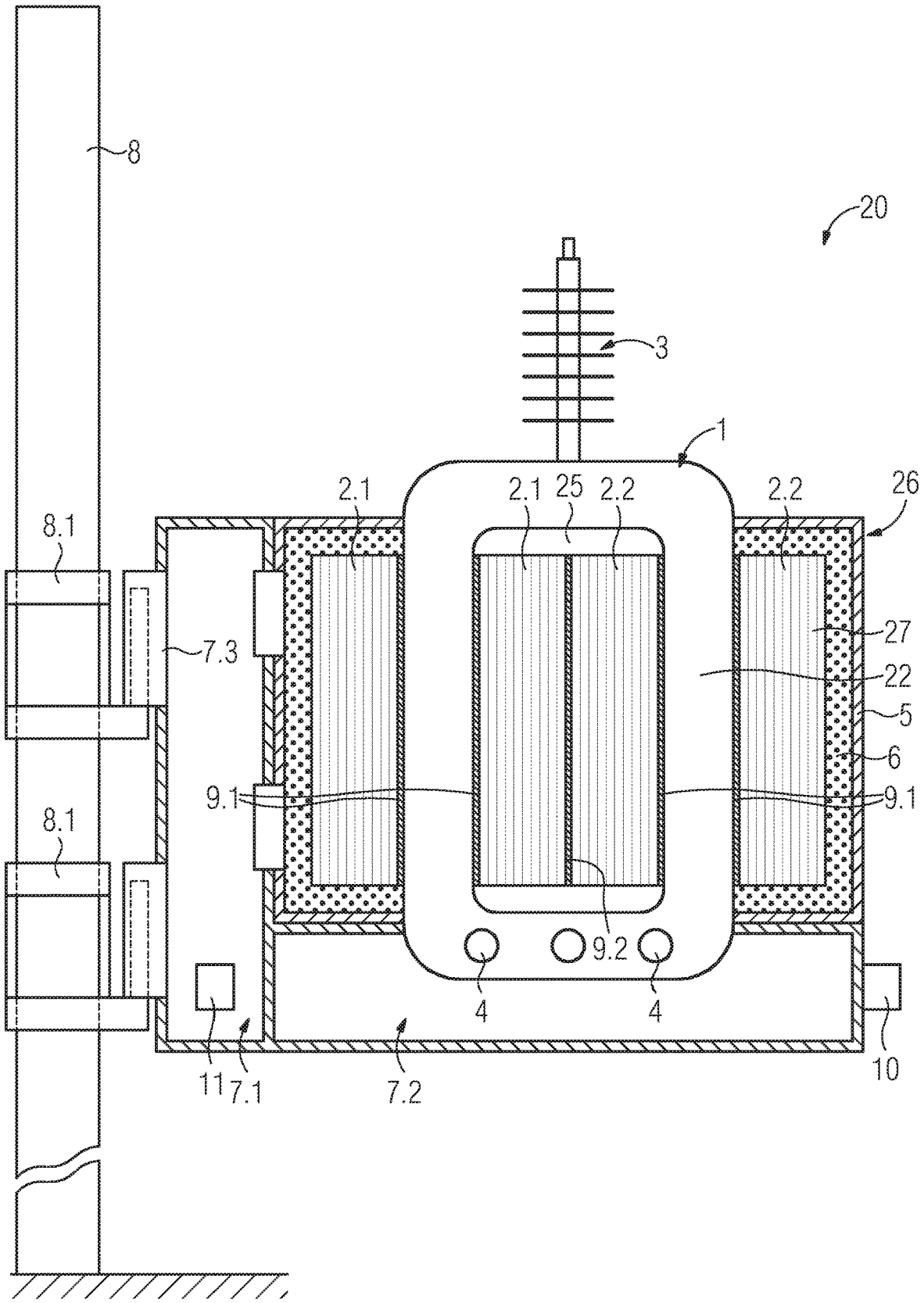
FIG. 2 illustrates the transformer according to FIG. 1, in a mounted position on a mast.

FIG. 2 illustrates the fastening of the transformer 20 according to FIG. 1 to a mast 8. To this end, the transformer 20 incorporates retaining means, which comprise a fastening rail 7.1 which is fastened to the mast 8 by means of two hook-shaped mast brackets 8.1. In each case, the fastening rail 7.1 constitutes a mating element 7.3 for the hook-shaped mast brackets 8.1, such that the fastening rail 7.1 can be rapidly and simply hooked into the mast bracket 8.1. The fastening rail 7.1 is rigidly connected to the supporting frame 5.

In addition to the mast bracket 8.1, the fastening rail 7.1, the mating element 7.3 and the supporting frame 5, the retaining means comprise a base structure 7.2 which, in the exemplary embodiment represented in FIG. 2, is rigidly connected to the supporting frame 5 and supports the winding body 1 from below, such that an additional stabilization of the transformer 1 is ensured. In the exemplary embodiment represented, the fastening rail 7.1 and the base structure 7.2 are configured as separate components which are connected to one another in a detachable manner.

For assembly, the winding body 1 is firstly produced, together with the bushing 3. Thereafter, the cores 2.1 and 2.2 are fitted around the winding body limbs 21 and 22, wherein the intermediate layers 9.1 and 9.2 are inserted. Thereafter, the supporting frame 5 is fitted, together with the corrosion-protection and insulating material 6. The fitting of the fastening rail 7.1 and the base structure 7.2 is then executed. The final stage is suspension in the mast bracket 8.1, which has previously been secured to the mast 8. In order to simplify assembly, for example with the aid of lifting vehicles such as cranes or similar, suspension openings 11 are provided in the retaining means M.

Figure 3:
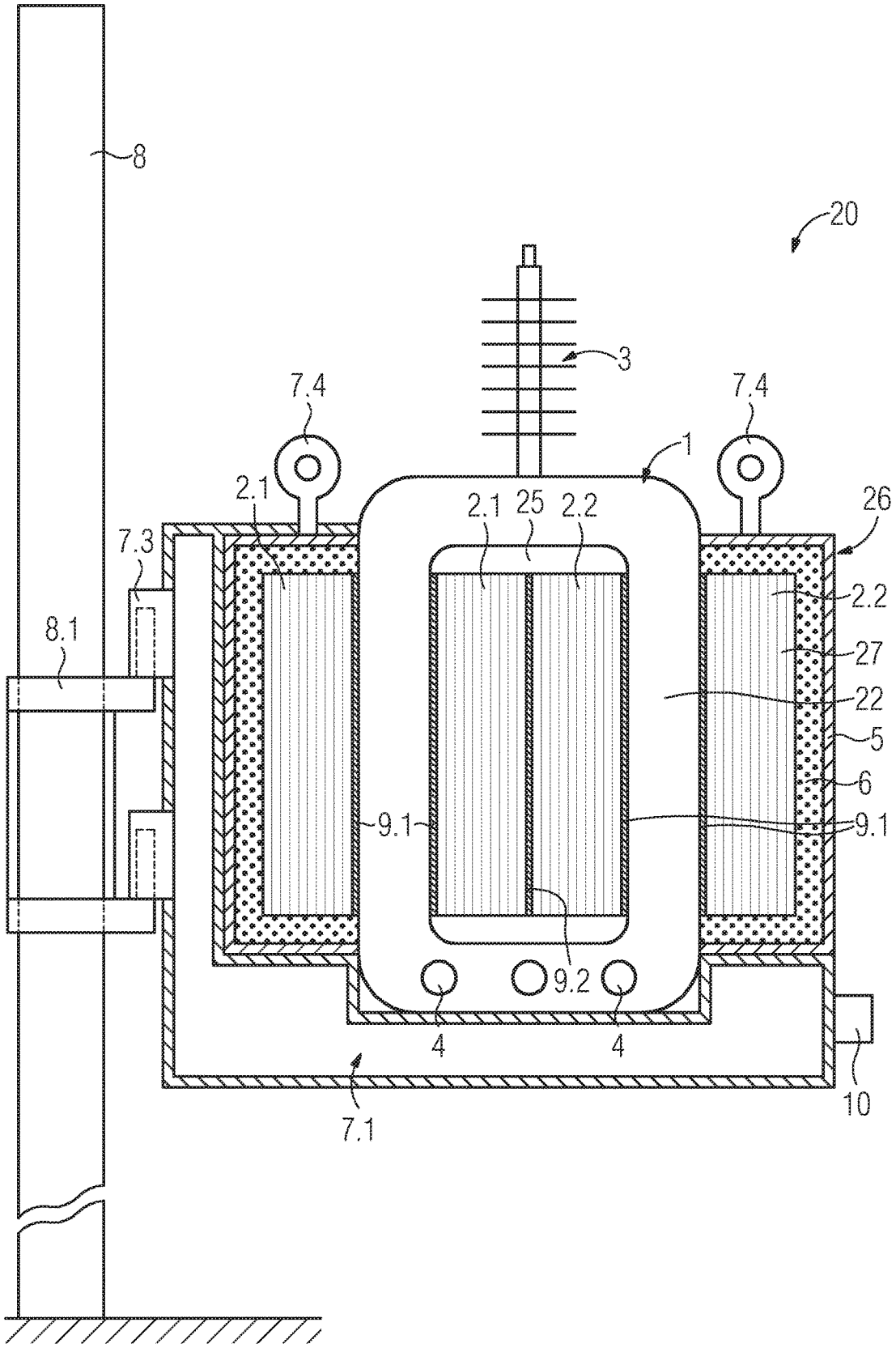
FIG. 3 illustrates a further exemplary embodiment of the transformer according to the invention.

FIG. 3 shows a further exemplary embodiment of the transformer 20 according to the invention. The mast bracket 8.1 shown here is equipped with an upper and a lower mast bracket 8.1, wherein each mast bracket 8.1 constitutes only a single hook, in which one mating element 7.3 can be suspended respectively. The mating elements 7.3 are again arranged on the fastening rail 7.1 which, on the side thereof which is averted from the mating element 7.3, is rigidly connected to a part of the supporting frame 5. The fastening rail 7.1, conversely to the exemplary embodiment represented in FIG. 2, is configured with an L-shape, and comprises a perpendicular section, which extends parallel to the mast, and a horizontal section, at which the fastening rail 7.1 engages with the winding body 1 from below. The fastening rail 7.1, at the side thereof which is averted from the mast 8, is also connected in this case to another part of the supporting frame 5, such that the winding body 1, the core unit 26 and the retaining means 5, 7.1 and 7.3 constitute a stable unit. The two said parts of the supporting frame 5 are screwed together. The part of the supporting frame 5 which is averted from the mast 8, in an overhead view of the transformer 20, is configured with a C-shape and, at the ends of its free limb, is screwed to that part of the supporting frame 5 which extends longitudinally in one direction.

Lifting lugs 7.4 which are fastened to the supporting frame 5 simplify the installation of the transformer 20 on the mast 8 by means of a lifting crane.

The invention claimed is:

1. A transformer for mounting on a mast of an air-insulated energy distribution network, having:

a winding block having a solid insulating body, and at least one higher-voltage winding and at least one lower-voltage winding disposed in said solid insulating body, wherein said winding block delimiting an entirely peripherally closed central retention opening;

a core unit having at least one magnetizable core being inductively coupled to said at least one lower-voltage winding by means of said at least one higher-voltage winding, wherein said at least one magnetizable core having at least one core limb and a ring portion, said core unit extending through said retention opening by means of said at least one core limb and annularly enclosing said winding block on an exterior by means of said ring portion; and a retainer for fastening said ring portion to the mast, said retainer including a supporting frame which entirely encloses said ring portion, said supporting frame containing a closed peripheral sidewall with a C-shaped cross-section, which entirely encloses said ring portion.

2. The transformer according to claim 1, wherein said core unit is impregnated with a curable polymer.

3. The transformer according to claim 1, further comprising an insulating material disposed between said supporting frame and said ring portion.

4. The transformer according to claim 1, wherein:

said winding block has block limbs; and said core unit contains two cores each having a core limb, each of said cores extends with said core limb through said retention opening, and each of said cores encloses one of said block limbs of said winding body over its full periphery.

5. The transformer according to claim 4, further comprising at least one intermediate layer disposed between said core limbs of said cores which extend through said retention opening, said at least one intermediate layer delimiting cooling ducts.

6. The transformer according to claim 1, further comprising a plurality of intermediate layers disposed between said winding block and said core unit, said intermediate layers delimiting cooling ducts.

7. The transformer according to claim 1, wherein said retainer includes a fastening rail for fitting to the mast, and a hook connection.

8. The transformer according to claim 7, further comprising a base structure for a retention of said winding block, wherein said base structure is connected to said supporting frame.

9. The transformer according to claim 8, wherein said supporting frame and/or said base structure are equipped with a grounding nut.

* * * * *